US012178321B2

(12) United States Patent
Bergmann et al.

(10) Patent No.: US 12,178,321 B2
(45) Date of Patent: Dec. 31, 2024

(54) HYBRID ART TABLE/EASEL

(71) Applicant: LAKEWOOD CANDIES LLC, Lakewood, NJ (US)

(72) Inventors: Brochie Bergmann, Lakewood, NJ (US); Yaakov Landsman, Lakewood, NJ (US); Yehuda Ehrentreu, Lakewood, NJ (US)

(73) Assignee: Lakewood Candies LLC, Lakewood, NJ (US)

( * ) Notice: Subject to any disclaimer, the term of this patent is extended or adjusted under 35 U.S.C. 154(b) by 246 days.

(21) Appl. No.: 17/902,049

(22) Filed: Sep. 2, 2022

(65) Prior Publication Data

US 2024/0074578 A1 Mar. 7, 2024

(51) Int. Cl.

| | |
|---|---|
| ***A47B 85/02*** | (2006.01) |
| ***A47B 13/00*** | (2006.01) |
| ***A47B 13/08*** | (2006.01) |
| ***A47B 83/04*** | (2006.01) |

(52) U.S. Cl.

CPC ..... *A47B 85/02* (2013.01); *A47B 13/003* (2013.01); *A47B 13/081* (2013.01); *A47B 83/045* (2013.01); *A47B 2200/0043* (2013.01)

(58) Field of Classification Search

CPC ..... A47B 27/02; A47B 85/02; A47B 13/003; A47B 83/045; A47B 2200/0043; A47B 2200/0066; A47B 21/00; A47B 2021/0076

USPC ..... 108/7, 3, 25, 50.01, 50.02

See application file for complete search history.

(56) References Cited

U.S. PATENT DOCUMENTS

| | | | | | |
|---|---|---|---|---|---|
| 1,303,280 | A * | 5/1919 | Fliedner | A47B 17/02 | 312/285 |
| 1,851,299 | A * | 3/1932 | Banks | A47B 85/02 | 108/9 |
| 2,252,215 | A * | 8/1941 | Stearns | A47B 23/04 | 108/4 |
| 2,675,288 | A * | 4/1954 | Usher | A47B 17/036 | 312/231 |
| 2,742,336 | A * | 4/1956 | Holmberg | A47B 23/046 | 108/3 |
| 2,798,333 | A * | 7/1957 | Griffith | A47B 85/02 | 108/7 |
| 2,829,935 | A * | 4/1958 | Colleau | A47B 17/02 | 108/30 |
| 3,095,833 | A * | 7/1963 | Peter | A47B 85/02 | 108/166 |

(Continued)

*Primary Examiner* — Jose V Chen
(74) *Attorney, Agent, or Firm* — Weiss & Arons LLP

(57) ABSTRACT

An art furniture system that provides a tabletop is provided. The tabletop includes an easel region, a first and a second stationary region. The easel region is hingedly attached to the first stationary region. The art furniture system also includes two side supports. A first side support is disposed under, and fixedly attached to, the first stationary region. A second side support is disposed under, and fixedly attached to, the second stationary region. When the easel region is undeployed, the easel region is located between the first stationary region and the second stationary region such that the two stationary regions and the easel region form a flat surface. When the easel region is fully deployed, it is disposed at an angle between 83° and 88°, and most preferably at angle of 86°, with respect to a plane formed by a top surface of the first and second stationary regions.

12 Claims, 5 Drawing Sheets

(56) References Cited

U.S. PATENT DOCUMENTS

| | | | | |
|---|---|---|---|---|
| 4,397,245 | A * | 8/1983 | Washburn | B25H 1/18 108/9 |
| 5,101,736 | A * | 4/1992 | Bommarito | A47B 21/02 312/194 |
| 5,131,333 | A * | 7/1992 | Karasawa | A47B 19/06 108/1 |
| 6,220,180 | B1 * | 4/2001 | Janowitz | A47B 21/00 108/50.01 |
| 7,798,070 | B2 * | 9/2010 | Ooba | A47B 21/00 108/50.01 |
| 8,316,777 | B1 * | 11/2012 | Rosing | A47B 23/046 108/50.01 |
| 10,986,920 | B1 * | 4/2021 | Huang | A47B 13/081 |
| D1,022,538 | S * | 4/2024 | Bergmann | D6/651 |
| 2011/0168062 | A1 * | 7/2011 | Dellavecchia | A47B 27/02 108/106 |
| 2012/0026663 | A1 * | 2/2012 | Costamagna | A47B 21/00 108/3 |
| 2012/0145048 | A1 * | 6/2012 | Gao | A47B 21/00 108/28 |
| 2013/0061781 | A1 * | 3/2013 | Wong | A47B 23/04 108/3 |
| 2014/0373758 | A1 * | 12/2014 | Pajic | B64D 11/0624 108/3 |
| 2015/0257528 | A1 * | 9/2015 | Rosing | A47B 23/046 108/3 |
| 2017/0238699 | A1 * | 8/2017 | Vaillancourt | A47B 13/081 |
| 2017/0290415 | A1 * | 10/2017 | Hsu | A47B 21/00 |
| 2018/0289148 | A1 * | 10/2018 | Maynes | A47B 17/065 |

* cited by examiner

HYBRID ART TABLE/EASEL

FIELD OF TECHNOLOGY

Aspects of the disclosure relate to art furniture.

BACKGROUND OF THE DISCLOSURE

Art furniture is a specialized field. For the purposes of this application, the term art furniture should be understood to refer to furniture that, at least partially, plays a role in supporting the production of artwork.

Oftentimes, artwork can be produced in any reasonable setting. These settings may present reduced space. As such, it would be desirable to provide certain hybrid pieces of art furniture that combine the use of various pieces of art furniture into a single piece of furniture. This approach obtains benefits in a limited space setting with respect to the reduction in the size of the area occupied by the art furniture.

This approach of combining furniture also reduces clutter. When two pieces of furniture are combined into one, the number of pieces of furniture is reduced. In an art classroom, this reduction in the number of pieces of furniture in the art classroom saves clutter, and also enables more space to be preserved for the artists.

However, combining multiple pieces of furniture into a simple piece of furniture should preferably maintain the individuality of each of the combined pieces of furniture. It is an object of the invention to combine two pieces of art furniture into a single piece of art furniture.

It is a further object of the invention to combine two pieces of art furniture in a way that makes the most of space for use in an art classroom for multiple pieces of similar furniture.

It is a further object of the invention to combine two pieces of art furniture in a way that maintains the individual utility of each piece of furniture.

SUMMARY OF THE DISCLOSURE

A hybrid art table/easel including a tabletop is provided. In one exemplary embodiment, the hybrid art table/easel includes a tiltable region, a first stationary region and a second stationary region. The tiltable region is hingedly-attached to the first stationary region. In an undeployed state, the tiltable region forms a part of the tabletop that is located between the first stationary region and the second stationary region. The hybrid art table/easel may preferably include two side supports; a first side support disposed under, and fixedly attached to, the first stationary region; and a second side support disposed under, and fixedly attached to, the second stationary region.

When the tiltable region is in an undeployed state, the two stationary regions and the tiltable region forms a single flat surface. When the tiltable region is in a fully deployed state, the tiltable region is disposed at an angle between 80° and 90° and most preferably 83° and 88° with respect to a plane formed by the upward-facing surface of the two stationary regions. Most preferably, when the tiltable region is in a fully deployed state, the tiltable region is disposed at an angle of 86° with respect to a plane formed by the upward-facing surface of the two stationary regions.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF THE DISCLOSURE

Figure 1:
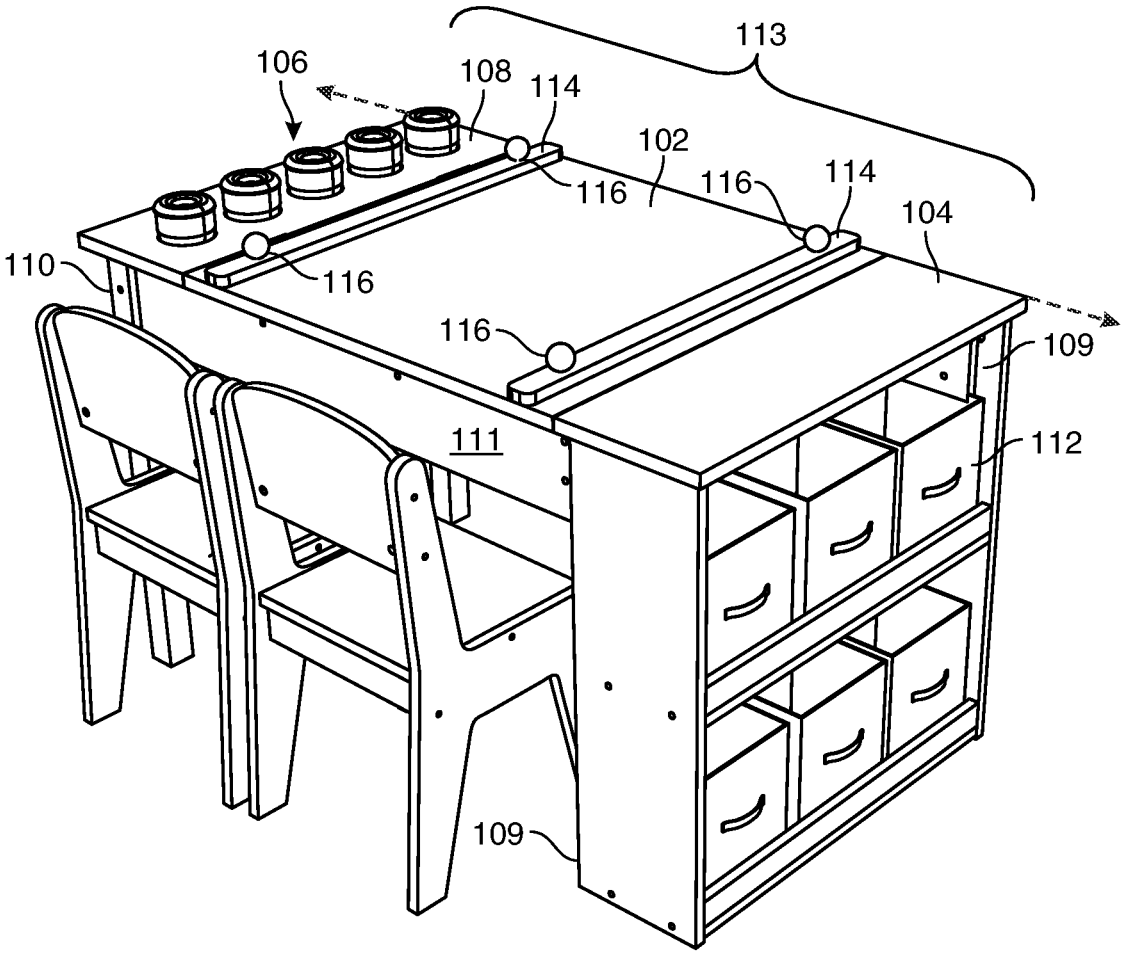
FIG. 1 shows a perspective view of a hybrid art table/easel system according to the disclosure.

An art furniture system is provided. The art furniture system includes a tabletop. The tabletop may include an easel region, a first stationary region and a second stationary region. The easel region may be hingedly attached to the first stationary region. The art furniture system may also include two side supports. A first side support may be disposed under, and fixedly attached to, the first stationary region. The second side support may be disposed under, and fixedly attached to, the second stationary region.

When the easel region is in an undeployed state, the easel region may be located between the first stationary region and the second stationary region such that the two stationary regions and the easel region form a flat surface. When the easel region is in a fully deployed state, the easel region may be disposed at an angle between 83° and 88°, and most preferably 86°, with respect to a plane formed by a top surface of the first stationary region and a top surface of the second stationary region.

The art furniture system may also include two frame members. A first of the frame members may couple a first end of the first side support to a first end of the second side support and a second of the frame members may couple a second end of the first side support to a second end of the second side support.

In another embodiment the hybrid art table/easel may include a tiltable region and one stationary region. It may also include two side supports. A first side support may be disposed under and fixedly attached to the stationary region. A second side support may be fixedly attached to the frame member. When the easel is in an undeployed state the tiltable region forms part of the tabletop that is located between the stationary region and the second side support.

In another embodiment the hybrid art table/easel may include a tiltable region and two side supports. When the easel is in an undeployed state the tiltable region may lay on top of the two side supports. The tabletop may be formed by the tiltable region.

In other embodiments the hybrid art table/easel may include a tiltable region and two side supports. The tiltable region may be connected next to one side support and on top of the other. When the easel is in an undeployed state the tiltable region may lay on top of one of the side supports. The tabletop may be formed by the tiltable region and one side support.

The art furniture system may also include two mounting braces and two gas struts, gas springs, gas pistons, pneumatic pistons, spring arms and any other suitable lifting and support structures. An exemplary embodiment may include one mounting brace and one gas strut, gas spring, gas piston, pneumatic piston, spring arm or any other suitable lifting and support structures. The first of the two gas struts may be pivotably coupled to the first side support by a first of the two mounting braces. A second of the two gas struts may be pivotably coupled to the second side support by a second of the two mounting braces.

In some embodiments, a first of the two gas struts may be pivotably attached at a first end of the first strut to a first underside of the easel region and pivotably attached at a second end of the first strut to the first frame member.

In some embodiments, a second of the two gas struts may be pivotably attached at a first end of the second strut to a second underside of the easel region and pivotably attached at a second end of the second strut to the second frame member.

The art furniture system may include multiple mounting braces. The first of the two gas struts is pivotably coupled to an underside of the easel region by a first of the mounting braces. The first of the mounting braces may be fixedly connected to an underside of the easel region. A second of the two gas struts may be pivotably coupled to the underside of the easel region by a second of the mounting braces. The second of the mounting bracings may be fixedly connected to the underside of the easel region.

In certain embodiments, the first and or second side supports may include a plurality of cubbies for storage. The plurality of cubbies may be disposed under the stationary region associated with the side support. In exemplary embodiments, the first and/or second side supports may include a plurality of shelves, drawers, cabinets or any other suitable storage space.

In some embodiments, the first and/or second stationary regions may include a plurality of apertures for retaining a plurality of receptacles. Such receptacles may, for example, be used as paint containers for holding paint for use with artwork prepared with the easel. In another embodiment the receptables may be used to hold crayons, markers, paint brushes or any other suitable paint supplies.

It should be noted that when the easel region is in a deployed state, the easel region may preferably be disposed at an angle of 86° with respect to a plane formed by the two stationary regions.

In certain embodiments, the pressure rating for each gas strut may be between 70 Newtons and 90 Newtons, and most preferably be 80 Newtons. It should be noted that the choice, composition and operation of the gas struts should preferably in compliance with the standards set forth in ASTM F-963-17, or a different, similar standard.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is to be understood that other embodiments may be utilized, and that structural, functional and procedural modifications may be made without departing from the scope and spirit of the present disclosure.

The steps of methods may be performed in an order other than the order shown or described herein. Embodiments may omit steps shown or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

FIG. 1 shows a perspective view of a hybrid art table/easel system according to the disclosure. The chairs are shown to illustrate the context of the disclosure but not necessarily for part of the embodiment. In some embodiments, a bench or chair may be incorporated and/or fixed to the table itself. The tabletop includes an easel portion 102 and two stationary portions 108 and 104. When easel portion 102 is not deployed, the top surfaces of these three portions form a substantially flat surface 113.

Also shown in FIG. 1 are side supports 109, 110. Each side support 109, 110 is preferably provided to connect to, and support, a single one of stationary portions 104 and 108.

Side supports 109 may preferably be coupled to side support 110 via frame member 111 (only a single member shown in FIG. 1). It should be noted that when easel portion 102 is not deployed—it preferably rests on a support structure defined by frame member 111 as well as by side supports 109, 110. Such a support structure may preferably include a first frame member 111 mechanically coupling the side supports 109, 110 and a second frame member (not shown in FIG. 1) coupling side supports 109, 110 from a second side.

Additional features are shown in FIG. 1. For example, FIG. 1 also shows receptacles 106 resting in apertures (not shown in FIG. 1) that are found in stationary portion 108. FIG. 1 also shows cubby boxes 112 that sit in between side supports 110.

Also shown in FIG. 1 are easel accessories. Easel accessories include paper holder 114 as well as paper holder grips 116. In the alternative, the paper may be fixed to the easel using clips, rubber bands or any other suitable device.

Figure 2:
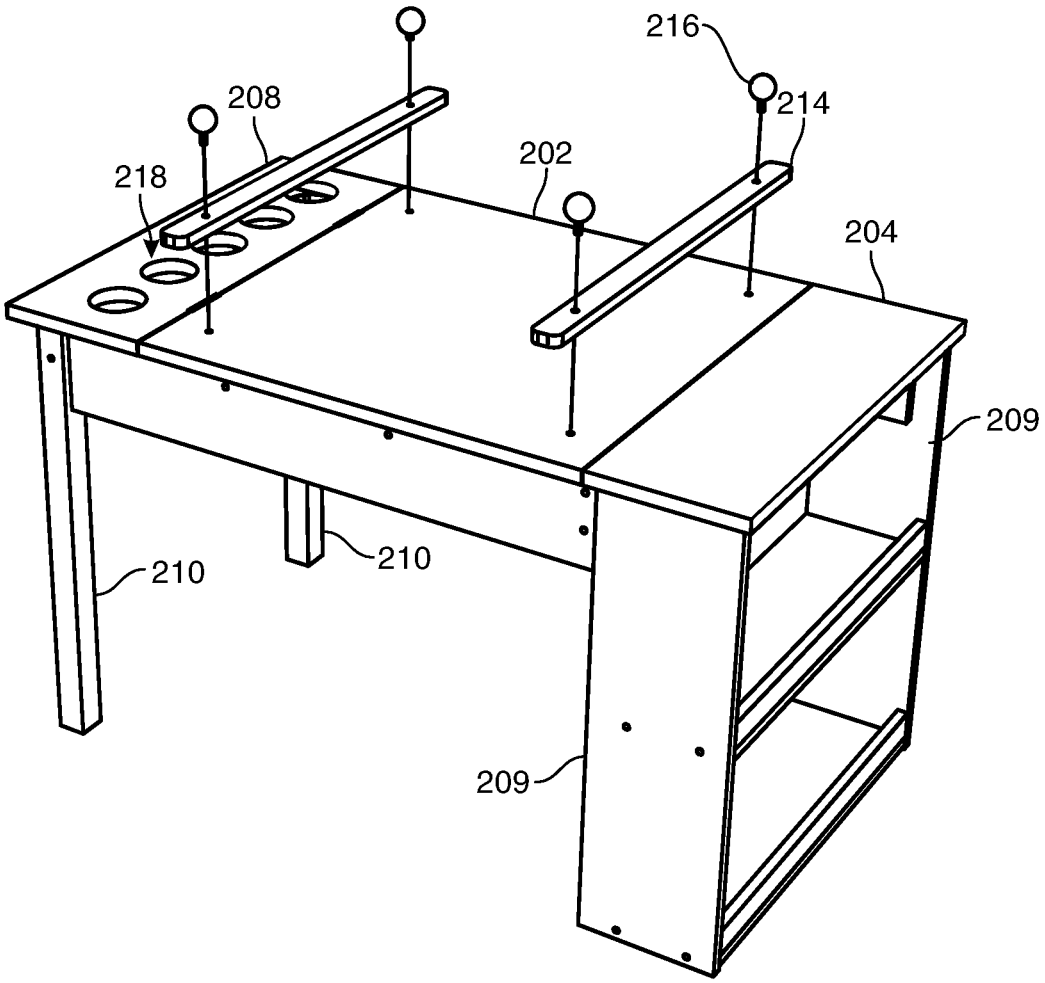
FIG. 2 shows an exploded view of easel paper holders and easel paper holder grips according to the disclosure.

FIG. 2 shows an exploded view of paper holders 214 and paper holder grips 216. Also shown in FIG. 2 are apertures 218 for holding receptacles (shown in FIG. 1). In addition, FIG. 2 also shows stationary portions 204, 208 and side supports 209, 210.

Figure 3:
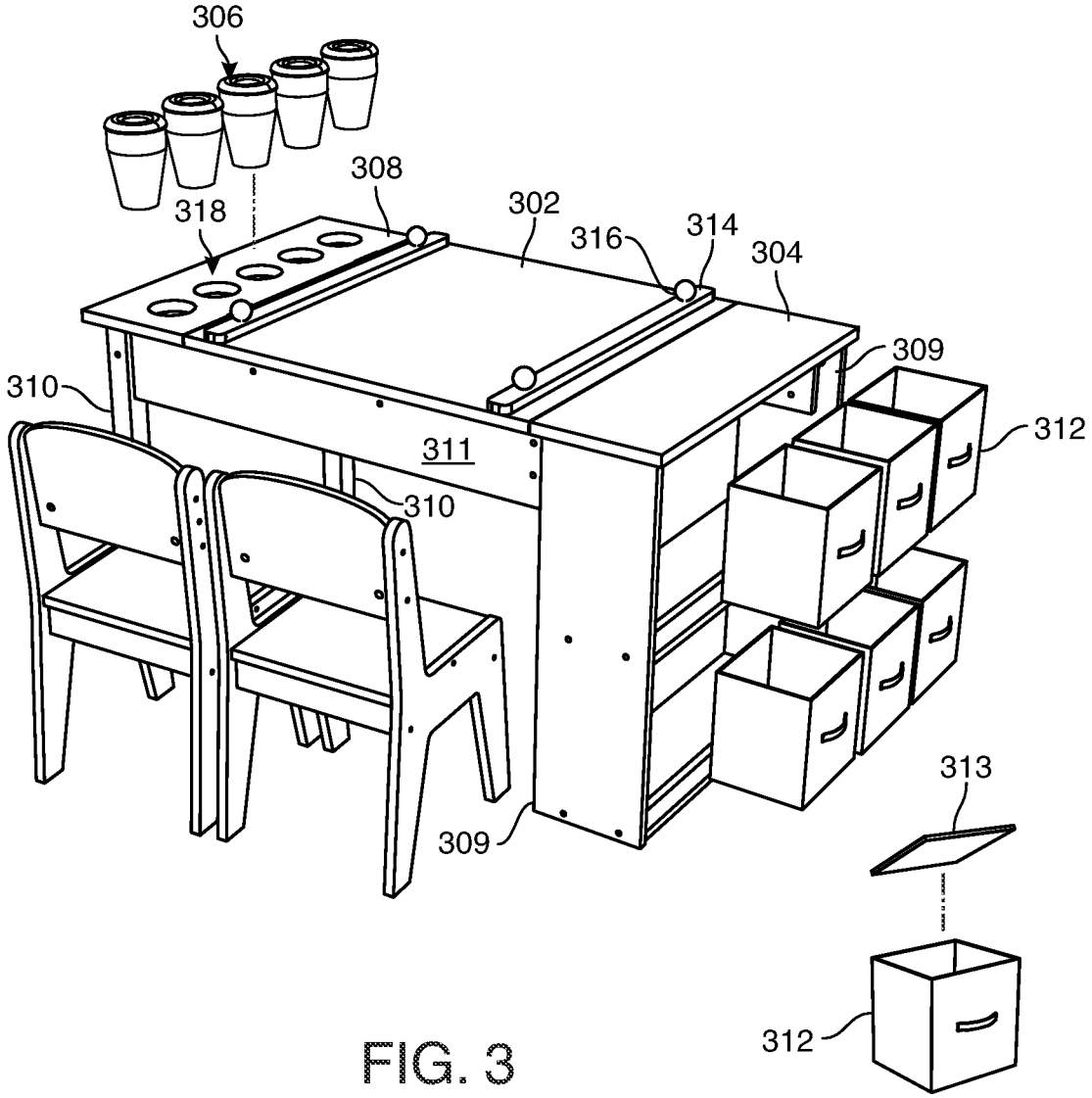
FIG. 3 shows an exploded view of cubbies, paint or supply cups, and storage boxes for use therein according to the disclosure.

FIG. 3 shows an exploded view of cubbies formed from boxes 312 (also shown is an individual cubby box 312 (referred to herein as cubbies) with optional bottom 313) as well as receptacles 306. Also shown in FIG. 3 are apertures 318 for holding receptacles (shown in FIG. 1). In addition, FIG. 3 also shows stationary portions 304, 308 and side supports 309, 310.

Figure 4:
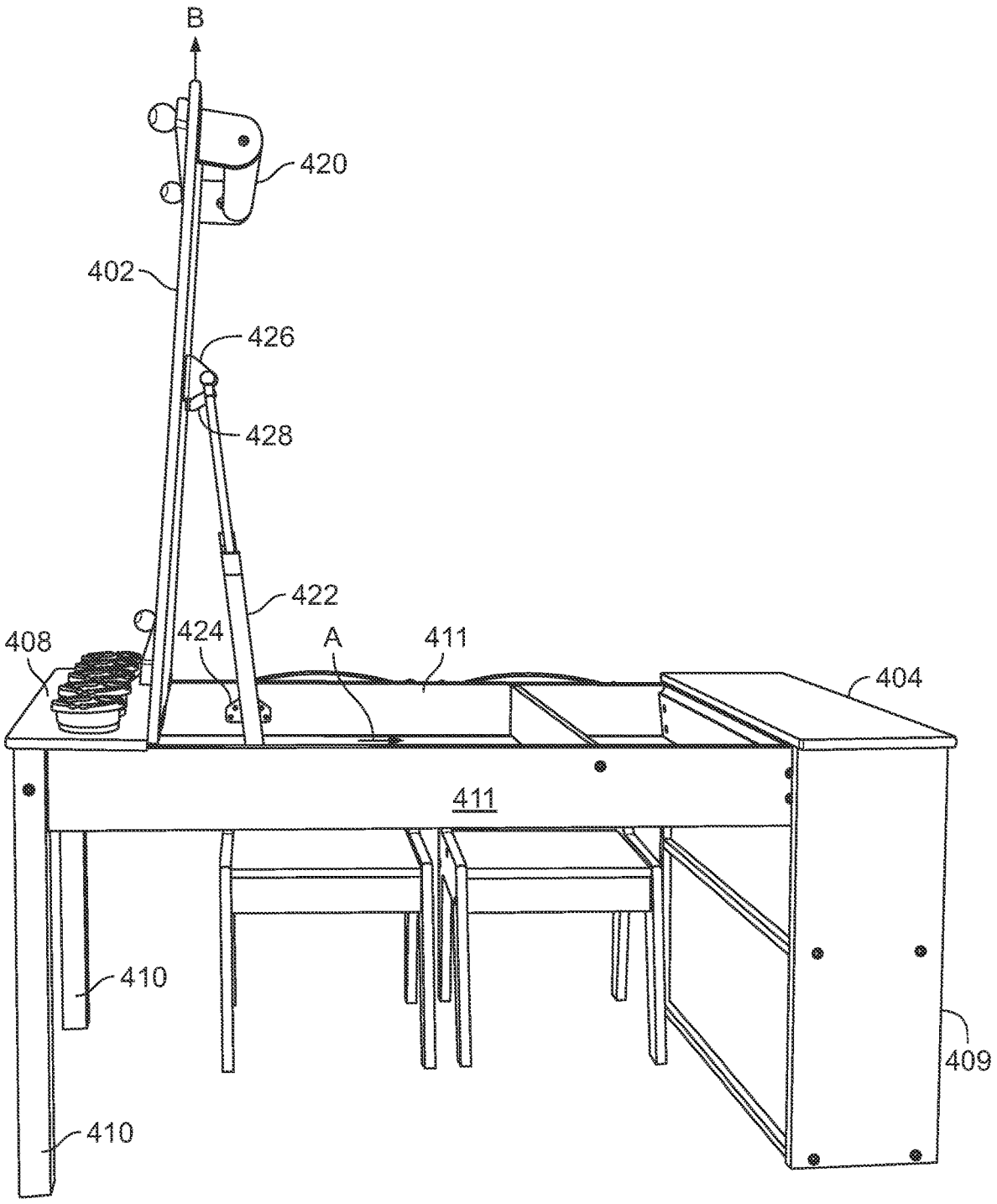
FIG. 4 shows an easel in a deployed state, according to the disclosure.

FIG. 4 shows easel 402 in a deployed state. FIG. 4 shows easel 402, first stationary portion 404, second stationary portion 408, side support 409, side supports 410, frame member 411, paper roll 420, gas strut 422, mounting brace 424, and mounting braces 426 and 428. In the deployed state, easel 402 is at an angle (formed by rays A and B) of between 83° and 88° with respect to a plane formed by the top surface of stationary portions 404 and 408. In the deployed state, easel 402 may most preferably be at an angle of 86° with respect to the plane formed by the top surface of stationary portions 404 and 408.

Figure 5:
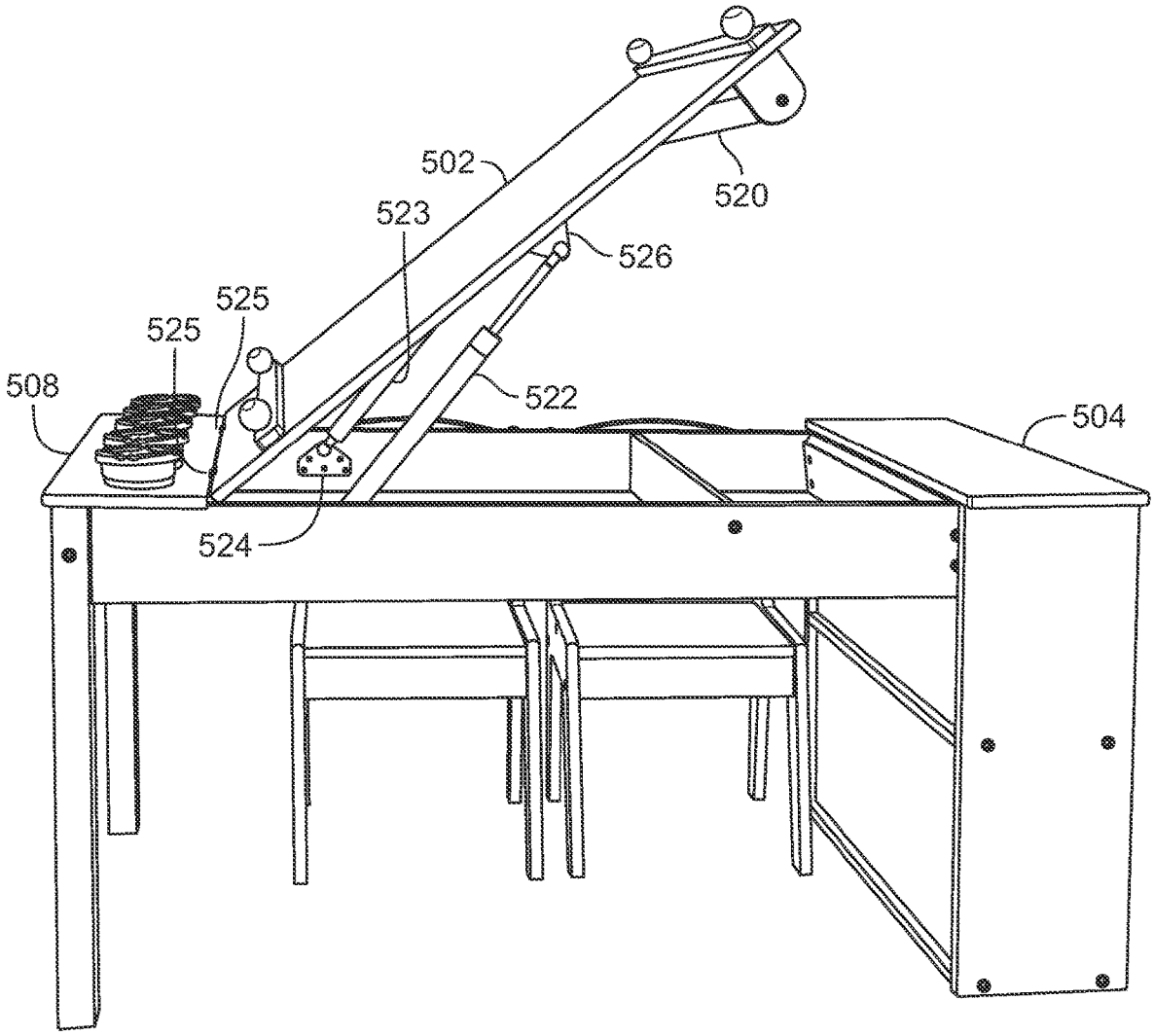
FIG. 5 shows an easel in a partially deployed state according to the disclosure.

FIG. 5 shows easel 502 in a partially deployed state. FIG. 5 shows easel 502 at an acute angle to a plane formed by the top surface of stationary portions 504 and 508.

FIG. 5 also shows gas struts 522 and 523. It should be noted that gas struts 522 and 523 are both pivotably attached to the underside of easel 502 (as shown, with respect to strut 522, at mounting brace 526). It should be noted that gas struts 522 and 523 are both pivotably attached to mounting braces mounted on frame pieces 511, as shown, with respect to strut 523, at mounting brace 524. Furthermore, easel 502 is preferably hingedly-mounted, as shown at 525, to stationary portion 508.

It should be noted that the material used to form the various structural aspects of the hybrid art table/easel may be plywood, MDF or construction material. Such plywood may be coated with a veneer or other substance—or may be some other substance such as a coating, a stain or other suitable substance. Such as a whiteboard or other suitable, wipeable surface. In some embodiments, the plywood may be ½" thick MDF.

Thus, systems for combining an art table and an easel into a combined art table/easel are provided. Persons skilled in the art will appreciate that the present invention can be practiced by other than the described embodiments, which are presented for purposes of illustration rather than of limitation. The present invention is limited only by the claims that follow.

What is claimed is:

1. A hybrid art table/easel comprising:

a tabletop, said tabletop comprising a tiltable region, a first stationary region and a second stationary region, said tiltable region hingedly attached to the first stationary region, said tiltable region located within the tabletop between the first stationary region and the second stationary region;

two side supports, a first side support disposed under, and fixedly attached to, the first stationary region and a second side support disposed under, and fixedly attached to, the second stationary region;

two frame members, a first of the frame members coupling a first end of the first side support to a first end of the second side support and a second of the frame members coupling a second end of the first side support to a second end of the second side support;

two gas struts, a first of said two gas struts pivotably attached at a first end of the first strut to a first side of the tiltable region and pivotably attached at a second end of the first strut to the first side support, and a second of the two gas struts is pivotably attached at a first end of the second strut to a second side of the tiltable region and pivotably attached at a second end of the second strut to the second side support; and two mounting braces, where the first of the two gas struts is pivotably coupled to an underside of the tiltable region by a first of the two mounting braces and a second of the two gas struts is pivotably coupled to the underside of the tiltable region by a second of the two mounting braces;

wherein, when the tiltable region is in an undeployed state, the two stationary regions and the tiltable region forms a flat surface, and when the tiltable region is in a fully deployed state, the tiltable region is disposed at an angle between 83° and 88° with respect to a plane formed by the two stationary regions; and the two mounting braces and the two gas struts are configured to enable the tiltable region to deploy orthogonally with respect to a forward-facing direction of two users seated at the hybrid art table/easel.

2. The hybrid art table/easel of claim 1, wherein the first side support comprises a plurality of cubbies for storage.

3. The hybrid art table/easel of claim 1, wherein the first stationary region second side support comprises a set of apertures for retaining receptacles.

4. The hybrid art table/easel of claim 1, wherein when the tiltable region is in a deployed state, the tiltable region is disposed at an angle of 86° with respect to a plane formed by the two stationary regions.

5. The hybrid art table/easel of claim 1, wherein the pressure rating for each gas strut is between 70 Newtons and 90 Newtons.

6. An art furniture system comprising:

a tabletop, said tabletop comprising an easel region, a first stationary region and a second stationary region, said easel region hingedly attached to the first stationary region;

two side supports, a first side support disposed under, and fixedly attached to, the first stationary region and a second side support disposed under, and fixedly attached to, the second stationary region;

two frame members, a first of the frame members coupling a first end of the first side support to a first end of the second side support and a second of the frame members coupling a second end of the first side support to a second end of the second side support;

two gas struts, a first of said two gas struts pivotably attached at a first end of the first strut to a first side of the tiltable region and pivotably attached at a second end of the first strut to the first side support, and a second of the two gas struts is pivotably attached at a first end of the second strut to a second side of the tiltable region and pivotably attached at a second end of the second strut to the second side support; and two mounting braces, where the first of the two gas struts is pivotably coupled to an underside of the tiltable region by a first of the two mounting braces and a second of the two gas struts is pivotably coupled to the underside of the tiltable region by a second of the two mounting braces;

wherein, when the easel region is in an undeployed state, said easel region located between the first stationary region and the second stationary region such that the two stationary regions and the easel region forms a flat surface, and when the easel region is in a fully deployed state, the easel region is disposed at an angle between 83° and 88° with respect to a plane formed by a top surface of the first stationary region and a top surface of the second stationary region; and the two mounting braces and the two gas struts are configured to enable the tiltable region to deploy orthogonally with respect to a forward-facing direction of two users seated at the art furniture system.

7. The art furniture system of claim 6, wherein the first side support comprises a plurality of cubbies for storage, said plurality of cubbies being disposed under the second stationary region.

8. The art furniture system of claim 6, wherein the first stationary region comprises a plurality of apertures for retaining a plurality of receptacles.

9. The art furniture system of claim 6, wherein when the easel region is in a deployed state, the easel region is disposed at an angle of 86° with respect to a plane formed by the two stationary regions.

10. The art furniture system of claim 6 wherein the pressure rating for each gas strut is between 70 Newtons and 90 Newtons.

11. A hybrid art table/easel comprising:

a tabletop, said tabletop comprising a tiltable region and a stationary region, said tiltable region hingedly attached to the stationary region;

two side supports, a first side support disposed under, and fixedly attached to, the stationary region and a second side support fixedly attached to, a first and second frame member, opposite the stationary region;

two frame members, a first of the frame members coupling a first end of the first side support to a first end of the second side support and a second of the frame members coupling a second end of the first side support to a second end of the second side support;

two gas struts, a first of said two gas struts pivotably attached at a first end of the first strut to a first side of the tiltable region and pivotably attached at a second end of the first strut to the first side support, and a second of the two gas struts is pivotably attached at a first end of the second strut to a second side of the tiltable region and pivotably attached at a second end of the second strut to the second side support; and two mounting braces, where the first of the two gas struts is pivotably coupled to an underside of the tiltable region by a first of the two mounting braces and a second of the two gas struts is pivotably coupled to the underside of the tiltable region by a second of the two mounting braces;

wherein, when the tiltable region is in an undeployed state, the stationary region and the tiltable region form a flat surface, and when the tiltable region is in a fully deployed state, the tiltable region is disposed at an acute angle with respect to a plane formed by the stationary region and the second side support; and the two mounting braces and the two gas struts are configured to enable the tiltable region to deploy orthogonally with respect to a forward-facing direction of two users seated at the art furniture system.

12. A hybrid art table/easel comprising:

a tabletop, said tabletop comprising a tiltable region, a first stationary region and a second stationary region, said tiltable region hingedly attached to the first stationary region, said tiltable region located within the tabletop between the first stationary region and the second stationary region;

two side supports, a first side support disposed under, and fixedly attached to, the first stationary region and a second side support disposed under, and fixedly attached to, the second stationary region;

two frame members, a first of the frame members coupling a first end of the first side support to a first end of the second side support and a second of the frame members coupling a second end of the first side support to a second end of the second side support;

two gas struts, a first of said two gas struts pivotably attached at a first end of the first strut to a first side of the tiltable region and pivotably attached at a second end of the first strut to the first side support, and a second of the two gas struts is pivotably attached at a first end of the second strut to a second side of the tiltable region and pivotably attached at a second end of the second strut to the second side support; and two mounting braces, where the first of the two gas struts is pivotably coupled to an underside of the tiltable region by a first of the two mounting braces and a second of the two gas struts is pivotably coupled to the underside of the tiltable region by a second of the two mounting braces;

wherein:

when the tiltable region is in an undeployed state, the tiltable region forms a flat surface, said flat surface that lies on top of at least one of the first stationary region and the second stationary region;

when the tiltable region is in a fully deployed state, the tiltable region is disposed at an angle between 83° and 88° with respect to a plane formed by a bottom surface of the tiltable region when the tiltable region is in an undeployed state; and the two mounting braces and the two gas struts are configured to enable the tiltable region to deploy orthogonally with respect to a forward-facing direction of two users seated at the art furniture system.

* * * * *